United States Patent [19]

Takeda

[11] Patent Number: 4,526,329

[45] Date of Patent: Jul. 2, 1985

[54] MAGNETIC TENSIONING DEVICE

[75] Inventor: Shuji Takeda, Oume, Japan

[73] Assignee: Tanac Engineering Kabushiki Kaisha, Tokyo, Japan

[21] Appl. No.: 515,166

[22] Filed: Jul. 19, 1983

[30] Foreign Application Priority Data

Mar. 29, 1983 [JP] Japan ..... 58-53381

[51] Int. Cl.[3] ..... B65H 59/16

[52] U.S. Cl. ..... 242/155 M; 310/93

[58] Field of Search ..... 242/155 M, 155 R, 147 M, 242/147 R, 150 M, 150 R, 156, 156.2, 75.2, 75.4, 75.43; 310/93

[56] References Cited

U.S. PATENT DOCUMENTS

| | | | |
|---|---|---|---|
| 2,591,463 | 4/1952 | Parker | 242/155 M X |
| 2,607,820 | 8/1952 | Judd et al. | 242/155 M X |
| 2,688,789 | 9/1954 | Duryee | 242/155 M X |
| 2,724,065 | 11/1955 | Saxl | 242/155 M X |
| 3,022,025 | 2/1962 | Saxl | 242/155 M |
| 3,072,361 | 1/1963 | Fuller | 242/155 M |
| 3,113,746 | 12/1963 | Steen | 242/155 M |
| 3,797,775 | 3/1974 | White | 242/155 M |

*Primary Examiner*—Stanley N. Gilreath
*Attorney, Agent, or Firm*—Spencer & Frank

[57] ABSTRACT

A magnetic tensioning device comprises a main tension pulley to which a braking torque is applied, an absorbing lever for absorbing fluctuation in tension and a second tension pulley mounted at one end of the absorbing lever. Adequate tensioning is obtained by means of the main and second tension pulleys. The braking torque is generated by a permanent magnet and a magnetizable disc opposed to each other. When tension is received at the absorbing lever, it displaces and the distance between the magnet and the magnetizable disc is changed according to the displacement of the lever to generate a correcting braking torque.

7 Claims, 14 Drawing Figures

MAGNETIC TENSIONING DEVICE

BACKGROUND OF THE INVENTION

The present invention relates to a tensioning device for applying tension to the wire of a coil winding machine when it is wound, and more particularly to a magnetic tensioning device in which the braking torque is applied to the tensioning pulley of the device by opposing a magnet and a magnetizable disc without contact therebetween. An adequate tensioning device has been available for conventional coil winding machines used for winding wire supplied from a supply bobbin onto a coil bobbin. This device applies a certain tension to the wire during the winding operation of the coil winding machine. In such a tensioning device there are basically included a main tension pulley to which a braking torque is applied, an absorbing lever for absorbing fluctuations of the wire tension during the winding operation and a second tension pulley provided at the swinging end of the absorbing lever, and tension is applied to the wire drawn through the main tension pulley and the second tension pulley. Conventionally, the braking torque applied to the main tension pulley has been generated by mounting a band brake around the periphery of a disc which is made to rotate integrally with the main tension pulley. Thus, control of the breaking torque has been obtained by regulating the pressure to the band brake.

In such a conventional tensioning device, necessary tensioning of the wire is possible to a limited extent by regulation of the wire tension, but there have been the problem that the pressure of the band brake might change after long use of the band.

Therefore an object of this invention is to provide a magnetic tensioning device in which braking torque is applied to the main tension pulley by opposing magnet and a magnetizable disc opposed to each without contact therebetween.

Another object of the present invention is to provide a magnetic tensioning device in which the braking torque applied to the main tension pulley may be chosen by regulating the distance between the magnetic and the magnetizable disc.

A still further object of this invention is to provide a magnetic tensioning device in which a the normal running torque at the time of generation of an abnormal tension may automatically be recovered.

Still another object is to provide a magnetic tensioning device in which unevenness of rotation of the main tension pulley may be prevented.

SUMMARY OF THE INVENTION

The magnetic tensioning device according to the present invention comprises a main tension pulley to which the braking torque is applied, an absorbing lever for absorbing fluctuations in tension, and a second tension pulley provided at the swinging end of the absorbing lever. Tension is applied to the wire drawn through the main tension pulley and the second tension pulley. The device further comprises: means for generating a braking torque consisting an opposing magnet and a magnetizable disc, which applies the generated braking torque to the main tension pulley; means for setting a normal running torque which sets the braking torque at the time of normal running by the distance between the magnet and the magnetizable disc; means for correcting the torque which enlarges the distance, with respect to the present during normal running, between the magnet and magnetizable disc when the absorbing lever displaces; means for transmitting the displacement of the absorbing lever to the torque correcting means; and means for urging which applies the rotational force to the absorbing lever.

BRIEF DESCRIPTION OF THE DRAWINGS

FIG. 13(*b*) is a view showing the structure of the cam assembly.

DETAILED DESCRIPTION OF THE PREFERRED EMBODIMENT

Figure 1:
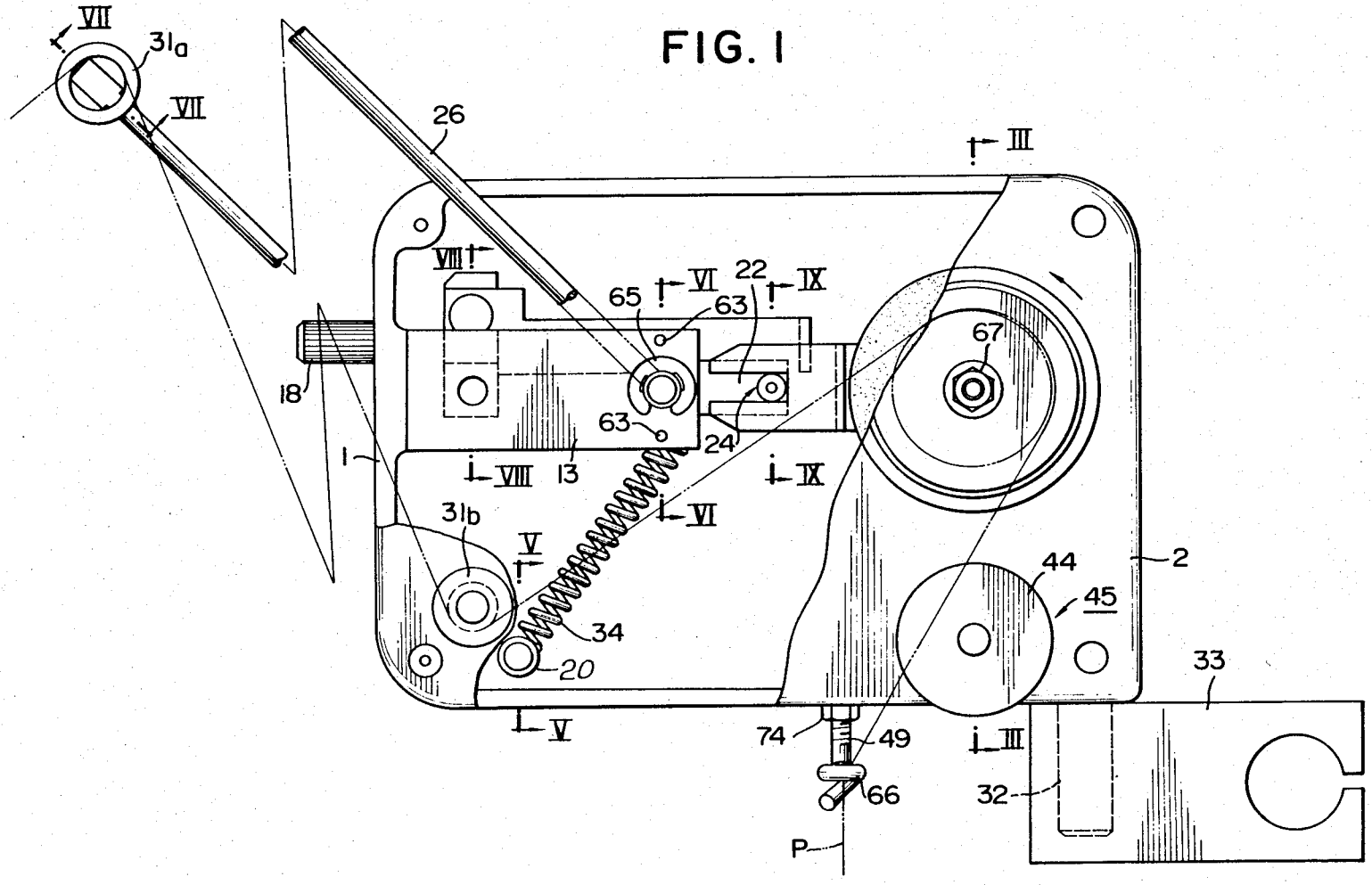
FIG. 1 is a front view, partly in section, of an embodiment of the magnetic tensioning device according to the present invention.

The structure of an embodiment of the magnetic tensioning device according to the present invention is explained with reference to FIGS. 1–4.

At the bottom face of the body 1 of a housing or device are mounted mounting shaft 32 and a Snell guide 66. The shaft 32 is to mount the body of the device onto a coil winding machine, not shown, and it protrudes from the body 1, being inserted into and fixed to a metal fitting 33 which fixes the body 1 to the coil winding machine. The Snell guide 66 is to guide wire P supplied from a supply bobbin, not shown, to a tensioning device. The Snell guide 66 is fixed to a metal guide fitting 49. On the other hand, the metal guide fitting 49 has threads and with the threads it is rotatably mounted into a threaded hole at the bottom of the body 1. To the threads of the fitting 49 a nut 74 is rotatably mounted, with which the guide portion of the Snell guide 66 may be fixed in the desired direction.

The front of the body 1 is closed with a cover 2, and at the outer surface of the cover 2 there are provided a main tension pulley 12, an auxiliary tension pulley 31*b*, and a second tension pulley 31*a* which is provided at one end of an absorbing lever or tension bar 26. Wire P supplied from the supply bobbin, not shown, is passed on the Snell guide 66 and guided through a wire pad 45 to the main tension pulley 12, where it is passed around the pulley twice to form turns. To the main tension pulley 12 is applied the braking torque from means for generating braking torque which will be explained hereinafter. The wire P is further guided through the auxiliary tension pulley 31*b* and passed on the second tension pulley 31*a* provided at one end of the tension lever 26. The wire P is then drawn and coiled by the rotation of the coil bobbin driven by the coil winding machine, not shown. The tension lever 26 is provided in order to absorb fluctuations in the tension of the wire P at such time. The auxiliary tension pulley 31*b* is provided to change the running direction of the wire P so that the length of wire around the main and second tension pulleys 12 and 31*a* is increased.

At the outer back face of the body 1 is provided a dial 4 for adjusting a means for setting the running torque. A knob 18 at the left side of the body 1 (is received in FIGS. 1 and 2) is provided for regulating the applied power to give a rotative force to the tension lever 26.

The detailed structure of the illustrated embodiment of the invention is explained hereinafter together with the operation of the device.

The functions of the wire pad 45 or to guide the wire guided by the Snell guide 66 to the main tension pulley 12 and to prevent slippage from or loosening of the wire P at the main tension pulley 12. As clearly shown in FIG. 3, the wire pad 45 comprises two felt pads 45*a* and 45*b* which are contained within and attached with adhesive to covers 43 and 44, respectively. Wire pad cover 43 is fixed to the cover 2 of the body 1 by a sleeve 41, the axial movement of the sleeve 41 being regulated at the inner face of the cover 2 by an E ring 60. A regulating bar 42 is inserted through the sleeve 41 movably in the axial direction of the sleeve 41. At one end thereof the wire pad cover 44 is fixed with a screw 68, while at the other threaded end thereof there is threaded a regulating nut 46. A spring 48 is inserted between the regulating nut 46 and the sleeve 41.

By pushing the regulating nut 46 the pad 45*b* attached to the wire pad cover 44 is separated from the pad 45*a* attached to the wire pad cover 43, so that the wire P may be inserted therebetween. The holding force exerted between the wire pads may easily be set by changing the urging force of the spring 48, which may be accomplished by rotation of the regulating nut 46.

The braking torque generating means provided applies the braking torque to the main tension pulley 12 by means of a permanent magnet 38 and opposing magnetizable disc 39, such as an iron plate.

Figure 3:
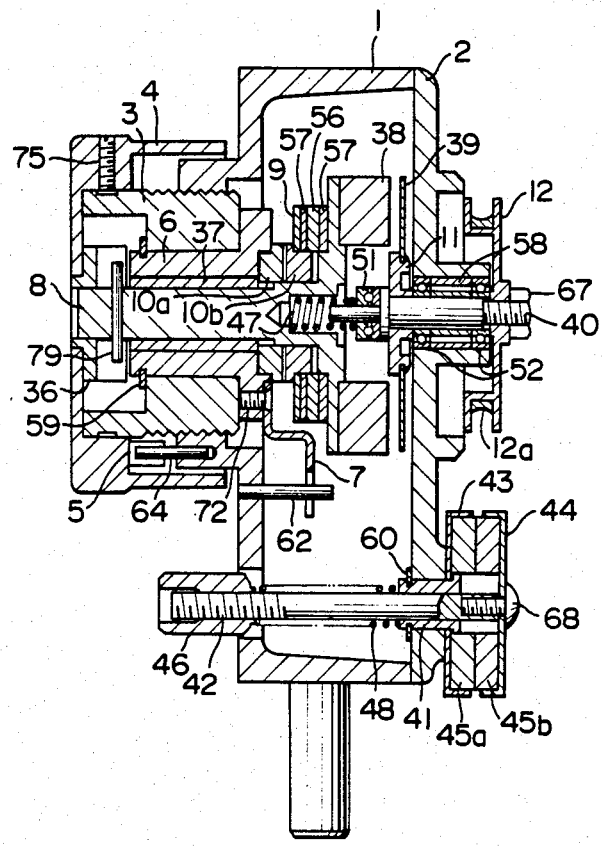
FIG. 3 is a side sectional view of the embodiment of the magnetic tensioning device cut along the line III—III of FIG. 1.
Figure 4:
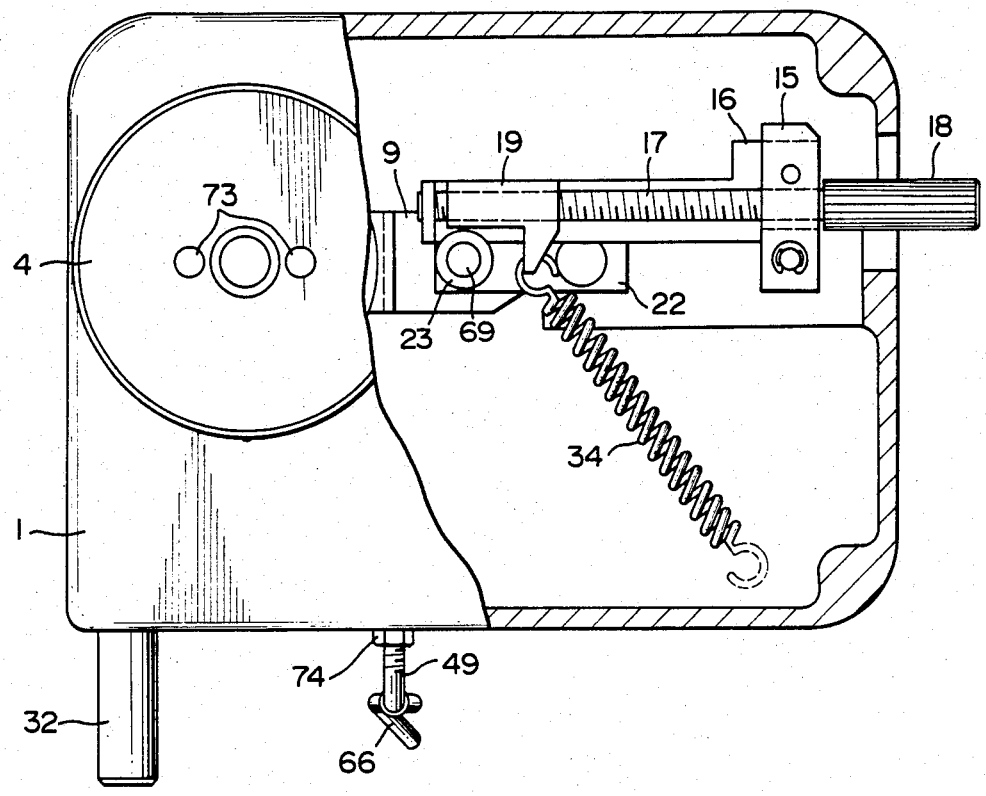
FIG. 4 is a back view of the magnetic tensioning device according to the present invention, partly in section.
Figure 11:
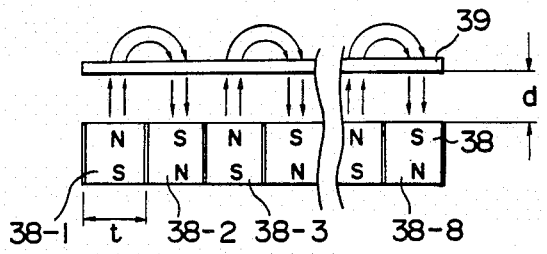
FIG. 11 is a schematic diagram for explaining the relationship between the magnet and the magnetizable disc.

The main tension pulley 12 is, as clearly shown in FIG. 3, clamped and fixed to a pulley shaft 40 with a left-handed nut 67. Within the groove of the main tension pulley 12 is integrally formed a rubber nonskid member 12*a*. The pulley shaft 40 is rotatably supported on the cover 2 with radial bearings 52, 52, and a one-way clutch 58 is further provided between the radial bearings 52 and 52. Thus, the pulley shaft 40 may be rotated only in the counterclockwise direction of FIG. 1. A disc flange 11 is fixed to the pulley shaft 40 and the magnetizable disc 39 is mounted on the disc flange 11. To the rear part of the pulley shaft 40 of smaller diameter a thrust bearing 51 is inserted and between it and an axial bore in the front end of a shaft 8 a pressure spring 47 is inserted. With this structure the pulley shaft 40 can rotate smoothly with respect to the shaft 8, which is urged toward the left in FIG. 3. On the disc of the shaft 8 the permanent magnet 38 is provided opposed to the magnetizable disc 39. The magnet 38 consists of eight permanent magnet pieces 38-1 to 38-8 in the present embodiment. The braking torque is generated as follows: FIG. 11 shows the relation of the magnet 38 and the magnetizable disc 39 in an exploded form. In the figure, the portion of the magnetizable disc 39 opposed to the permanent magnet piece 38-1 is magnetized to form an S pole, while the portion opposed to the permanent magnet piece 38-2 is form an N pole. The magnetizable disc 39 tends to move in the right in FIG. 11 but the S pole portion of the magnetizable disc 39 receives not only an attracting force from the permanent magnet piece 38-1 but a repulsive force from the permanent magnet piece 38-2. In the same manner, the portion of the magnetizable disc 39 opposed to the permanent magnet piece 38-2 receives an attracting force from the piece 38-2 and a repulsive force from the next permanent magnet piece 38-3. The sum of these forces is a braking force to prevent the movement of the magnetizable disc 39. It can be realized that the braking force is a inversely proportional to the distance d between the surface of the permanent magnet 38 and the magnetizable disc 39.

When the magnetizable disc 39 moves against the braking force through a distance equal to one pole, the portion of the disc 39 previously magnetized to from an N pole is now magnetized to form our S pole, while the previously magnetized portion to form an S pole is now magnetized to form an N pole. And when disc 39 further tends to move through a distance equal to one more pole, it again receives attracting and repulsive forces from the magnet pieces. Thus, the magnetizable disc 39 is continuously influence by the braking force.

In the illustrated embodiment of the invention the distance d between the permanent magnet 38 and the magnetizable disc 39 is beforehand set according to the diameter of the wire and the coil winding speed. By precisely regulating the distance d according to the angular position of the lever 26, a constant tension is always applied to the wire P.

The one-way clutch 58 is provided for the following reason: There arises a problem during an operation in which a strong braking force is required, that the time in which the distance d between the magnet 38 and the magnetizable disc 39 is small ends, and the operation where a relatively weak braking force is required starts. If the magnetizable disc 39 is stopped in the vicinity of the permanent magnet 38, the portions of the magnetizable disc 39 opposed to the respective magnet pieces are magnetized, corresponding to the magnet pieces.

The distance d between the permanent magnet 38 and the magnetizable disc 39 is adjusted by rotating the magnet 38 with a dial 4 as will be explained hereinafter.

As mentioned above, a force exists between the permanent magnet 38 and the magnetizable disc 39 so as not to change the relative angular position. By the rotation of the permanent magnet 38, the distance between the magnet 38 and the magnetizable disc 39 increases. In this state, unless the rotation of the disc 39 is restricted therewith, the magnetizable disc 39 rotates following the rotation of the permanent magnet 38. As a result, the distance between the magnetizable disc 39 and the permanent magnet 38 only becomes larger, but the relative angular position between them does not change. This means that the magnetizable disc 39 is in the state of being magnetized in the vicinity of the magnet 38, while the distance between the magnet 38 and disc 39 is enlarged. Now assume that the portion in the disc 39 opposed to the magnet piece 38-1 shown in FIG. 11 is magnetized to form an S pole, and that the magnetizable disc 39 begins to rotate and move forward the right in the figure. As already explained, because the portion of magnetizable disc 39 opposed to the permanent magnet piece 38-1 receives a repulsive force from the permanent magnet piece 38-2 and also an attracting force from the piece 38-1, the repulsive and attracting force works a sum to prevent movement of the disc. However, when the portion opposed to the magnet piece 38-1 reaches this portion opposed to the magnet piece 38-2, the magnetic force received by the position of the disc 39 is smaller than that which existed when the distance between the magnet 38 and disc 39 was d and there is the possibility that the disc is not magnetized to an ideal N pole but that the S pole remains there. In that condition, the permanent magnet 38 can not provide a normal braking force to the magnetizable disc 39 and this might be the causes of a ripple in the braking force or other unexpected troubles. It will easily be understood that in the reverse case, that is, when the distance d changes from a larger value to a smaller value, such a problem does not occur.

The one-way clutch 58 supports the magnetizable disc 39 so that the disc 39 does not rotate following the rotation of the permanent magnet 38 in the direction where the distance between the magnetizable disc 39 and the magnet 38 increases, and it does not obstruct the rotation of the magnetizable disc 39 when the coil is being wound. Even if the permanent magnet 38 moves toward the left in FIG. 11, the movement of the magnetizable disc 39 toward the left is obstructed by the one-way clutch 58.

Figure 12:
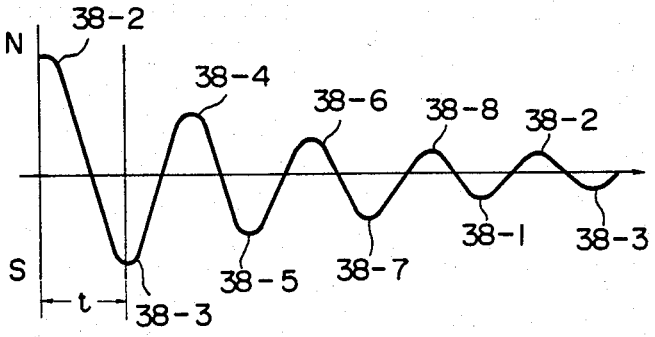
FIG. 12 is a graph for explaining the magnetic characteristic of the magnetizable disc.

As for the portion of the disc 39 opposed to the magnet piece 38-2, an explanation is now given with reference to FIG. 12. At first this portion is magnetized to form an N pole by the magnet piece 38-2. When the magnet piece 38-2 draws near this portion of the disc 39, disc 39 is magnetized to form an S pole. In this case, since the distance between this portion and the magnet piece 38-3 is somewhat larger than that between it and the magnet piece 38-2, the extent of magnetization is somewhat smaller. In the same manner, this portion is magnetized so as to reverse poles in turn, but the amplitude of the magnetic force gradually becomes smaller and the initial state disappears.

In order to set the distance d between the magnet 38 and the magnetizable disc 39 when the during such normal running conditions means for setting the torque during such normal running is provided.

At the back face of the body 1 is provided an internally threaded cylindrical protrusion, which is clearly shown in FIG. 3. An externally threaded cylindrical torque regulation ring 3 is threaded into the body 1. The inner portion of the torque regulation ring 3 consists of a comparatively small diameter hole and a larger diameter hole. The dial 4 is fixed to the torque regulation ring 3 with a screw 75. A stopper pin 5 is mounted on the dial 4 and is in contact with a spring pin 64 mounted on the body 1. Within the thick inner portion of the torque regulation ring 3 of smaller inner diameter a bearing case 6 is rotatably inserted. The axial movement of the bearing case 6 is restricted by a C ring 59 provided at one end of the bearing case 6. A rotation stopper plate 7 is fixed within the body 1 by a screw 72 at the other end of the bearing case 6. The rotation of the stopper plate 7 itself is restricted by a pin 62 mounted on the body 1. The shaft 8 is rotatably supported by a bearing 37 within the bearing case 6. A pin mounted on the shaft 8, not shown, is engaged with a stopper 36 fixed to the dial 4 and thus the shaft 8 rotates integrally with the dial 4.

According to the rotation of the dial 4, the torque regulation ring 3 and the shaft 8 are rotated integrally with each other. Since the torque regulation ring 3 is connected with the body 1, the shaft 8 moves in the axial direction while being rotated. The bearing case 6 may be rotated with respect to the torque regulation ring 3 and the shaft 8, while the rotating with respect to the body 1 is stopped by the stopper plate 7. Thus, movement in the axial direction only is allowed. Therefore, the space between the permanent magnet 38 at one end of the shaft 8 and the magnetizable disc 39 may be changed without changing the rotational position of the cam pieces **10*a*, 10*b* of a cam assembly provided in the front end of the bearing case 6. When the running torque is normal, the cam assembly is kept in its largest displacement position by a swinging lever 9 which will be explained hereinafter. This positions corresponds to the state where the permanent magnet 38 and the magnetizable disc 39** are in the their closest proximity with respect to each other. With the above structure, the necessary tension of the wire may be set. According to the present embodiment, the torque for the main tension pulley may be set within the range of 2 kgcm and 0.2 kgcm, the value being determined by the diameter of the wire and the feeding speed thereof, etc.

Means for modifying the torque consists of the cam assembly supported by a normal running torque setting means and urged by the pressure spring 47, which when rotated enlarges the distance between the permanent magnet 38 and the magnetizable disc 39 after the distance has been set by the normal running torque setting means.

Figure 13A:
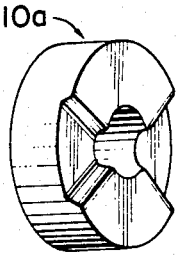
FIG. 13(*a*) is a view showing the face of a cam of a cam assembly used in the invention.
Figure 13B:
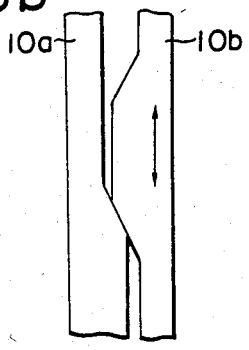

The cam **10*a* of the cam assembly is fixed to the bearing case 6 and has a cam face as shown in FIG. 13(*a*). The cam face of the cam 10*a* contacts with the cam face of the cam 10*b*. Since the bearing case 6 does not rotate, the rotational position of the cam 10*a* is constant. The cam 10*b* is rotatably supported on the shaft 8 and at the outer side of the cam 10*b* is integrally provided a disc of the swinging lever 9. Between the discs of the swinging lever 9 and the shaft 8, a thrust bearing 56 is inserted through thrust washers 57 and 57. According to the rotation of the swinging lever 9, the cam 10*b* displaces, as shown in the exploded form in FIG. 13(*b*), with respect to cam 10*a*, thus enabling the change of the displacement of the cam assembly between maximum and to minimum positions. In the ordinary case, the cam assembly is set to its maximum displacement position, or in other words, the nearest position of the magnet 38 with the magnetizable disc 39**.

Means for transmission is used to transmit the displacement of the tension lever 26 to the cam assembly, an explanation on which is given hereinafter.

Figure 2:
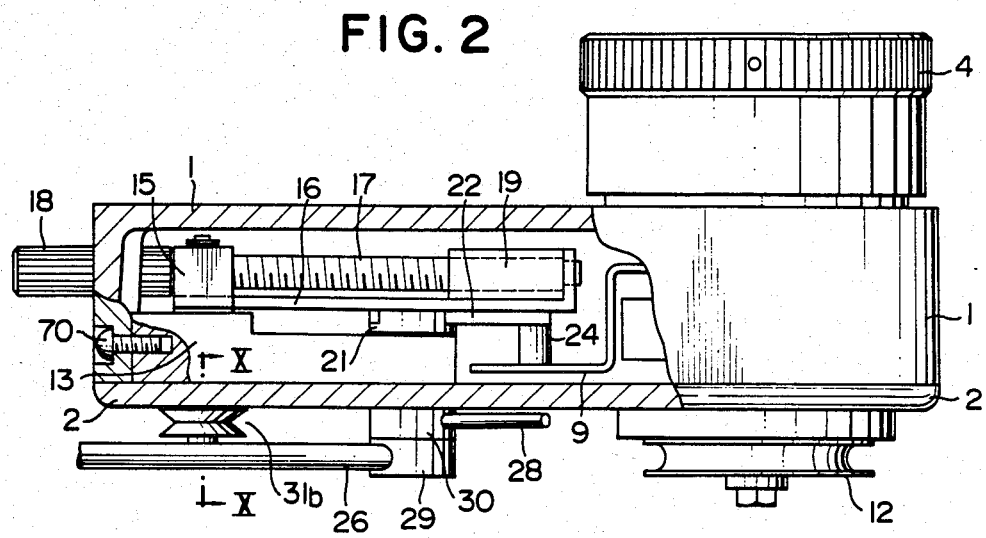
FIG. 2 is a plan view, partly in section, of the embodiment of the present invention shown in FIG. 1.
Figure 6:
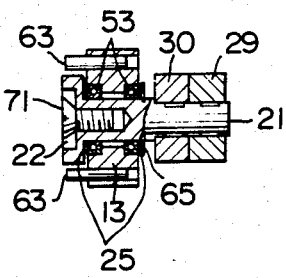
FIG. 6 is a sectional view cut along the line VI—VI of FIG. 1.
Figure 7:
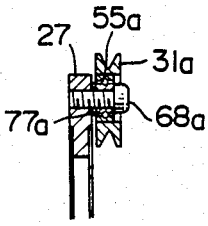
FIG. 7 is a sectional view along the line VIII—VIII of FIG. 1.
Figure 9:
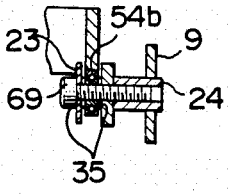
FIG. 9 is a sectional view along the line IX—IX of FIG. 1.
Figure 10:
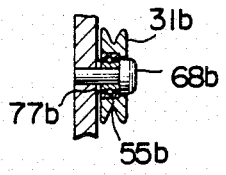
FIG. 10 is a sectional view along the lines X—X of FIG. 2.

The tension lever 26 as shown in FIG. 1, and FIG. 2 is mounted on a tension ring 29, which is inserted together with a switch bar ring 30 into a tension shaft 21. A switch bar 28 is mounted on the switch bar ring 30. As shown in FIG. 7, at an end of the tension lever 26 is provided a pulley mounting piece 27 on which the second tension pulley **31*a* is mounted through a radial bearing 55*a*. The bearing 55*a* is fixed with a screw 68*a*. The tension shaft 21 is mounted to a housing 13 (FIGS. 1, 2 and 6) through radial bearings 53, 53** and the housing 13 is fixed to the body 1 with a screw 70. The axial movement of the tesnion shaft 21 is restricted by an E ring 65. At the other end of the tension lever 26 there is fixed a tension bar 22 with a screw 71. The extent of rotation of the tension bar 22 is restricted by two spring pins 63, 63 provided in the housing 13. As shown in FIG. 9, a radial bearing 54*b* is fixed with a screw 69 through bearing spacers 35, 35 at the rear part of the other end of the tension bar 22. In the front side thereof, a swinging pin 24 is fixed also with the screw 69. The swinging pin 24 is engaged with the notch of the swinging lever 9. The radial bearing 54*b* is engaged with the lower end of a swing lever 16.

Tension is applied to the wire P through the second tension pulley 31*a*, by spring acting on the tension lever 26, an explanation of while will be given hereinafter.

Figure 5:
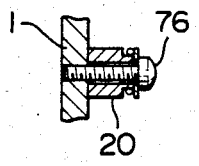
FIG. 5 is a sectional view cut along the line V—V of FIG. 1.
Figure 8:
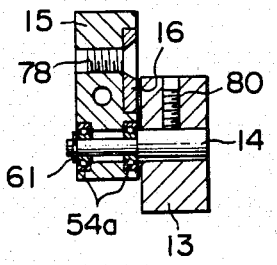
FIG. 8 is a sectional view along the line VIII—VIII of FIG. 1.

The swing lever 16 as shown in FIG. 8 is fixed to a lever holder 15 with a screw 78, while the holder 15 is rotatably supported on a lever shaft 14 by the radial bearings 54*a*, 54*a*, the shaft 14 being fixed on the housing 13 with a screw 80. The movement of the holder 15 in the axial direction is restricted by an E ring 61. The lever holder 15 is provided with a rotatably supported regulation screw 17 and the regulation knob 18 is provided for enabling the rotation of the screw 17 from outside of the body 1. The other end of the regulation screw 17 is rotatably mounted on the bent potion of the end of the swing lever 16. On the regulation screw 17 a nut 19 for mounting an end of a regulation spring 34 is threaded, the regulation spring 34 being mounted between the nut 19 and a pin 20. The pin 20 as shown in FIG. 5 is fixed to the body 1 with a screw 76.

By rotating the knob 18, the nut 19 may be moved forward or backward. Accordingly, the distance between the supporting points of the regulation spring 34 change and regulation of the urging power may be made. The position shown in FIG. 1 is where the spring 34 is urged in the strongest extent. The tension lever 26 vibrates in proportion to the tensile force of the wire P passed around the second tension pulley 31*a*, the lever 26 absorbing the tension of the wire P. At this stage, the cam 10*b* of the cam assembly is rotated with the displacement transmitted through the transmitting means, but its rotation is not as yet affected by the change of the cam face. Therefore at this stage the torque modifying means does not work.

In case the tension of the wire becomes larger than the set value between the main pulley 12 and the coil bobbin rotated by the coil winding machine, not shown, the tension lever 26 is rotated in the counterclockwise direction of FIG. 1. In this state, the shaft 21 and the tension lever 26 are rotated in the same direction and accordingly rotate the swinging lever 9 in the clockwise direction, the lever 9 being engaged with the swinging pin 24 provided at one end of the tension bar 22. According thereto, the cam 10*b* which is integral with the swinging lever 9 rotates and moves the shaft 8 to the left, as shown in FIG. 3. The permanent magnet 38 is thus moved apart from the magnetizable disc 39. The braking torque to the main tension pulley 12 may thus be reduced.

The entire operation of the magnetic tensioning device according to the present invention will now be explained.

The body 1 is fixed to the coil winding machine, not shown, and the wire from the supply bobbin is passed through the Snell guide 66. The direction of the Snell guide 66 is changed with a screw 74 to the direction of supply of the wire P.

The regulation nut 46 is pushed and the wire pad cover 44 is detached from the cover 43 to hold the wire P therebetween. The pressure of the regulation nut 46 is controlled by rotation of the nut taking the thickness of the wire into consideration.

The wire P is passed twice around the main tension pulley 12 and is further passed around the second tension pulley 31*a* through the auxiliary tension pulley 31*b*. The urging force of the tension lever 26 on which the second tension pulley 31*a* is mounted is adjusted by rotation of the regulation knob 18.

Before the operation of the coil winding machine starts, the dial 4 is rotated gently in the direction where it retreats from the body 1, and the magnetizable disc 39 is before hand demagnetized as already explained with reference to FIGS. 11 and 12. Then the braking torque is set by the rotation of the dial 4 taking into consideration the thickness of the wire P and other factors.

After the operation is started, the dial 4 is further regulated precisely taking into consideration the inclination of the tension lever 26, etc., and the normal running torque is set by the advance or retreat of the magnet 38 with respect to the magnetizable disc 39.

When an abnormal tension is generated on the wire P due to some causes, the tension lever 26 rotates, so that it then rotates the tension bar 22 and the swinging lever 9, etc. And finally it rotates the cam 10*b* of the cam assembly to increase the distance between the magnet 38 and the magnetizable disc 39. The braking torque applied to the main tension pulley 12 is thus reduced, the pulley 12 can rotate smoothly and the tension on the wire P is reduced.

When tension in to the wire P is reduced, the tension lever 26 rotates, urged by the spring 34 and displaces the cam assembly. The permanent magnet 38 now draws near the magnetizable disc 39 and returns the braking torque to the main tension pulley 12 to the beforehand set normal running torque. Thus adequate tension may be applied to the wire P.

As above mentioned in detail, according to the embodiment of this invention, non-contact braking torque is generated with the permanent magnet and the magnetizable disc and the normal running torque may be set by determining the distance between the magnet and the disc. When an abnormal tension arises, the set torque may be reduced by the torque modifying means. Thus constant tensioning of the wire becomes possible.

The explanation of the embodiment has been particularly directed to a wire tensioning device for a coil winding machine, but it should be realized that a device may widely be applied to other devices where a constant tension must be applied to the running wire.

What is claimed is:

1. A magnetic device for controlling the tension applied to a wire comprising a housing;

a main tension pulley rotatably secured to said housing;

a tension lever having one end displaceably attached to said housing;

a second tension pulley rotatably secured to the other end of said tension lever, said wire being fed through said main and second tension pulleys and having fluctuations in the tension thereof absorbed by displacement of said tension lever;

magnetic means for generating a braking torque on said main tension pulley, said magnetic means including a spaced magnet member and magnetizable disc;

adjusting means coupled to said magnetic means for setting the distance between said magnet member and said magnetizable disc, the distance between said magnet member and said disc set by said adjusting means determining the braking torque on said main tension pulley when said wire is under a normal running tension; and torque modifying means coupling said tension lever to said magnetic means, said torque modifying means increasing the distance between said spaced magnet member and said magnetizable disc when said tension lever is displaced with respect to said housing as the result of an increase in the tension of said wire.

2. A magnetic tensioning device according to claim 1, wherein said magnet member comprises a plurality of magnetic elements arranged in a circle, the polarization of adjacent magnetic elements being opposite with respect to each other.

3. A magnetic tensioning device according to claim 1, wherein said magnetizable disc is integrally connected to said main tension pulley for rotation therewith, the braking torque on said main tension pulley being determined by the magnetic force exerted on said disc by said magnet.

4. A magnetic tensioning device according to claim 1, wherein said adjusting means comprises a rotatably dial.

5. A magnetic tensioning device according to claim 4, wherein said spaced magnet member and said magnetizable disc are rotatable with respect to each other, the distance between said magnetic member and said disc increases as the relative angular rotation of said magnet member and said disc increases in a given direction, and wherein means are provided for limiting the relative rotation of said disc with respect to said magnet member to a predetermined amount.

6. A magnetic tensioning device according to claim 4, wherein said torque modifying means comprises a first cam which is rotated by the dial on said adjusting means and a second cam which is rotated in accordance with the displacement of said tension lever.

7. A magnetic tensioning device according to claim 1, wherein said torque modifying means further comprises a regulating screw, a nut mounted on said screw and a regulating spring interposed between said nut and said housing, rotation of said regulating screw controlling the force exerted by said tension lever.

* * * * *